US005159822A

United States Patent [19]

Schmid et al.

[11] Patent Number: 5,159,822

[45] Date of Patent: Nov. 3, 1992

[54] THREADING AND YARN-CHANGING DEVICE FOR YARN GUIDES

[75] Inventors: Franz Schmid, Bodelshausen; Fritz Walker, Kusterdingen, both of Fed. Rep. of Germany

[73] Assignee: H. Stoll GmbH & Co., Fed. Rep. of Germany

[21] Appl. No.: 667,228

[22] Filed: Mar. 11, 1991

[30] Foreign Application Priority Data

Mar. 14, 1990 [DE] Fed. Rep. of Germany ..... 4008058

[51] Int. Cl.[5] ..... D04B 15/56; D03D 47/34

[52] U.S. Cl. ..... 66/126 R; 139/450

[58] Field of Search ..... 6/126 R; 139/450

[56] References Cited

U.S. PATENT DOCUMENTS 4,359,068 11/1982 Loepfe et al. ..... 139/450 X
4,513,792 4/1985 Lincke ..... 139/450 X
4,520,849 6/1985 Suzuki et al. ..... 139/450 X
4,637,229 1/1987 Taylor, Jr. ..... 139/450 X
4,790,150 12/1988 Stoll ..... 66/126 R X
4,913,195 4/1990 Speich ..... 139/450 X
4,962,796 10/1990 Grimm et al. ..... 139/450

*Primary Examiner*—Werner H. Schroeder
*Assistant Examiner*—John J. Calvert
*Attorney, Agent, or Firm*—Larson and Taylor

[57] ABSTRACT

The threading and yarn-changing device allows yarn guides each to be equipped automatically and selectively with one of a plurality of yarns (14, 15). It possesses a nozzle head (11) and a yarn-proportioning device (12) with guide parts (30.1, 30.2) for each of the yarns (14, 15) and an additional yarn-clamping and cutting-off device (13) and can be arranged in a stationary or movable manner on a knitting machine.

6 Claims, 5 Drawing Sheets

THREADING AND YARN-CHANGING DEVICE FOR YARN GUIDES

FIELD OF THE INVENTION

The invention relates to a threading and yarn-changing device for yarn guides, especially for flat knitting machines, having at least one yarn-guide channel, the entry orifice of which is aligned with a yarn blowing-in nozzle of the device.

BACKGROUND OF THE INVENTION

It has already been proposed to introduce yarns into a yarn guide by means of a blowing nozzle (German Offenlegungsschrift 3,701,671).

The object on which the invention is based is to combine such a device with a yarn-changing device and so design it that it works in an operationally reliable way.

The set object is achieved, according to the invention, by means of a device of the type mentioned in the introduction, in that the yarn blowing-in nozzle of the device is formed in a nozzle head having inlet channels for a plurality of yarns and preceded by a yarn-proportioning part which for each of the plurality of yarns has a yarn-loop region located respectively between a front and a rear separately actuable yarn-clamping point and which is equipped with at least one yarn looper. Advantageously, a cutting-off device conventional on yarn-changing devices can be combined with the threading and yarn-changing device, and it can be arranged in the effective range of at least one yarn guide together with a yarn-clamping device for a yarn guided through the yarn guide and coming out of the yarn guide. The device can be arranged in a stationary manner, so that the yarn guides have to be fed to it for equipment or for the yarn change. However, the device together with its plurality of parts can also be made movable, so that it can be brought to the yarn guides.

The combined threading and yarn-changing device according to the invention allows an automatic equipment of the yarn guides and an automatic change of the yarns guided by them. On flat knitting machines, by means of the device designed according to the invention either the number of yarn guides used and to be controlled individually can be reduced, because a separate yarn guide no longer has to be provided for every colour or yarn type employed, or the device makes it possible to use a number of different yarns which exceeds the number of yarn guides to be employed on the machine.

The threading and yarn-changing device is so designed that a knitting machine does not have to be stopped in order to introduce a yarn into a yarn guide or to change the yarn. The high operating reliability required for this is achieved by means of a simple construction of the device, whereby the yarn-proportioning part can have a yarn looper common to all the yarns and in the form of a blowing-nozzle bar extending transversely relative to all the yarns and arranged above the plurality of yarn-loop regions. But a mechanically active yarn follow-up web lowerable into the plurality of yarn-loop regions arranged next to one another can also be provided as a yarn looper. By means of the blowing-nozzle bar or the yarn follow-up web, storage loops are formed in the yarn-proportioning device for each yarn to a length which is sufficient for a yarn to be introduced to be brought through the yarn guide into the additional clamping device or for it to be drawn back out of the yarn guide again into the nozzle head behind the blowing nozzle. The yarn-clamping points in front of and behind each of the yarn-loop regions of the yarn-proportioning device appropriately all arranged next to one another can advantageously each have a spring-loaded movable clamping jaw which is coupled to a pneumatic, hydraulic, electrical or mechanical adjusting member. The yarn-clamping points ensure either that a formed yarn loop remains protected as long as the respective yarn is not inserted, or that, to form the yarn loop, yarn can either be drawn off from a storage reel or be drawn back out of a yarn guide via the nozzle head, or else that an inserted yarn has a free run through the yarn-proportioning part.

An exemplary embodiment of a threading and yarn-changing device designed according to the invention is explained in more detail below by means of the accompanying drawing.

DETAILED DESCRIPTION OF THE PREFERRED EMBODIMENTS

Figure 1:
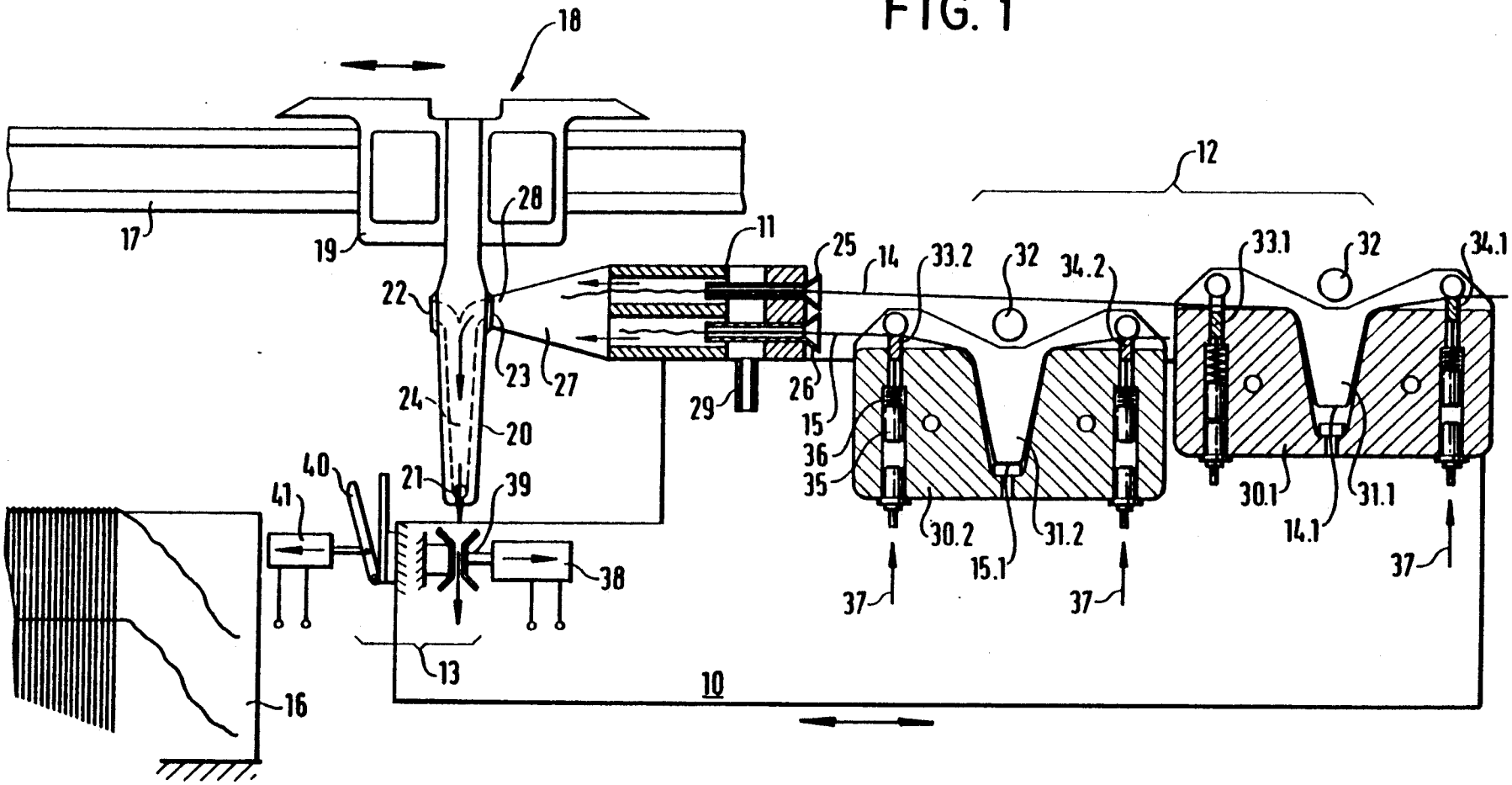
FIGS. 1 to 5 show the individual parts of the threading and yarn-changing device in conjunction with a yarn guide of a flat knitting machine in different operating states which the device assumes during a yarn change.

The threading and yarn-changing device arranged on a stationary or movable carrier 10 indicated merely diagrammatically has a nozzle head 11, a yarn-proportioning part 12 and an additional yarn-clamping and cutting-off device 13. The device allows a change between a plurality of individual yarns, but for the sake of clarity only the parts for two yarns 14 and 15 are shown.

Of a flat knitting machine, the Figures show in a diagrammatic representation a needle bed 16, a yarn-guide rail 17 and a yarn guide 18 arranged longitudinally adjustably on the yarn-guide rail 17 and having a yarn-guide carriage 19 and a yarn-guide arm 20. The yarn guide 18, on its yarn-guide arm 20, has a yarn exit orifice 21 and a left and a right yarn entry orifice 22 and 23, whilst separate yarn-guide channels 24 can run in the yarn-guide arm 20 between the yarn entry orifices 22, 23 and the yarn exit orifice 21.

The nozzle head 11 possesses, for each yarn of the device, a separate inlet channel 25, 26 with the following widening, all of these leading into a common blowing space 27 terminating in a common blowing nozzle 28 which is aligned with the yarn entry orifices 22 or 23 of the yarn guides 18. The compressed air is fed to the nozzle head 11 via a feed line 29 which leads via a valve arrangement (not shown).

The yarn-proportioning part 12 of the device has a plate-like guide body 30.1, 30.2, also referred to more generally as element 30, for each yarn 14, 15. The guide bodies 30 are arranged next to one another perpendicularly relative to the drawing plane. The two guide bodies 30.1 and 30.2 are shown offset relative to one another in the Figures merely for the sake of clarity. The guide bodies 30, here 30.1, 30.2, have in their middle part a deep indentation for a yarn-loop region 31, here 31.1, 31.2, also referred to more generally as element 31, and above these yarn-loop regions 31 of the guide bodies 30 extends a common yarn looper, here pneumatic and in the form of a blowing-nozzle bar 32, by means of which the yarns 14 and 15 can be blown in the yarn-loop regions 31 to form a yarn loop 14.1 or 15.1. The yarn looper may also take the form of a follow-up web extending transversely relative to all of the yarns and lowerable into the plurality of yarn-loop regions arranged next to one another. A yarn-clamping point with a movable clamping jaw 33, 34 is arranged in front of and behind each yarn-loop region 31. The yarn-clamping points of each guide body 30 are separately controllable, that is to say, here, the front yarn-clamping jaw 33.1 and the rear yarn-clamping jaw 34.1 of the guide body 30.1 for the yarn 14 and the front clamping jaw 33.2 and the rear clamping jaw 34.2 of the guide body 30.2 for the yarn 15. In the exemplary embodiment illustrated, the movable yarn-clamping jaws 33 and 34 are adjustable pneumatically and are coupled to an adjusting piston 35 which, in the state of rest, is maintained in an open position by means of a compression spring 36. The movable clamping jaws 33, 34 are thus brought into the clamping position by the supply of compressed air, this being indicated in the Figures by compressed-air arrows 37.

The additional yarn-clamping and cutting-off device 13 has a yarn clamp 39 with a movable clamping jaw, adjustable here by means of an electromagnet 38, and a shear 40 with a movable blade likewise adjustable by means of an electromagnet 41. The threading and yarn-changing device is assigned a control unit (not shown here), by means of which the successive and mutually coordinated control of the individual drive parts of the device is carried out.

Figure 2:
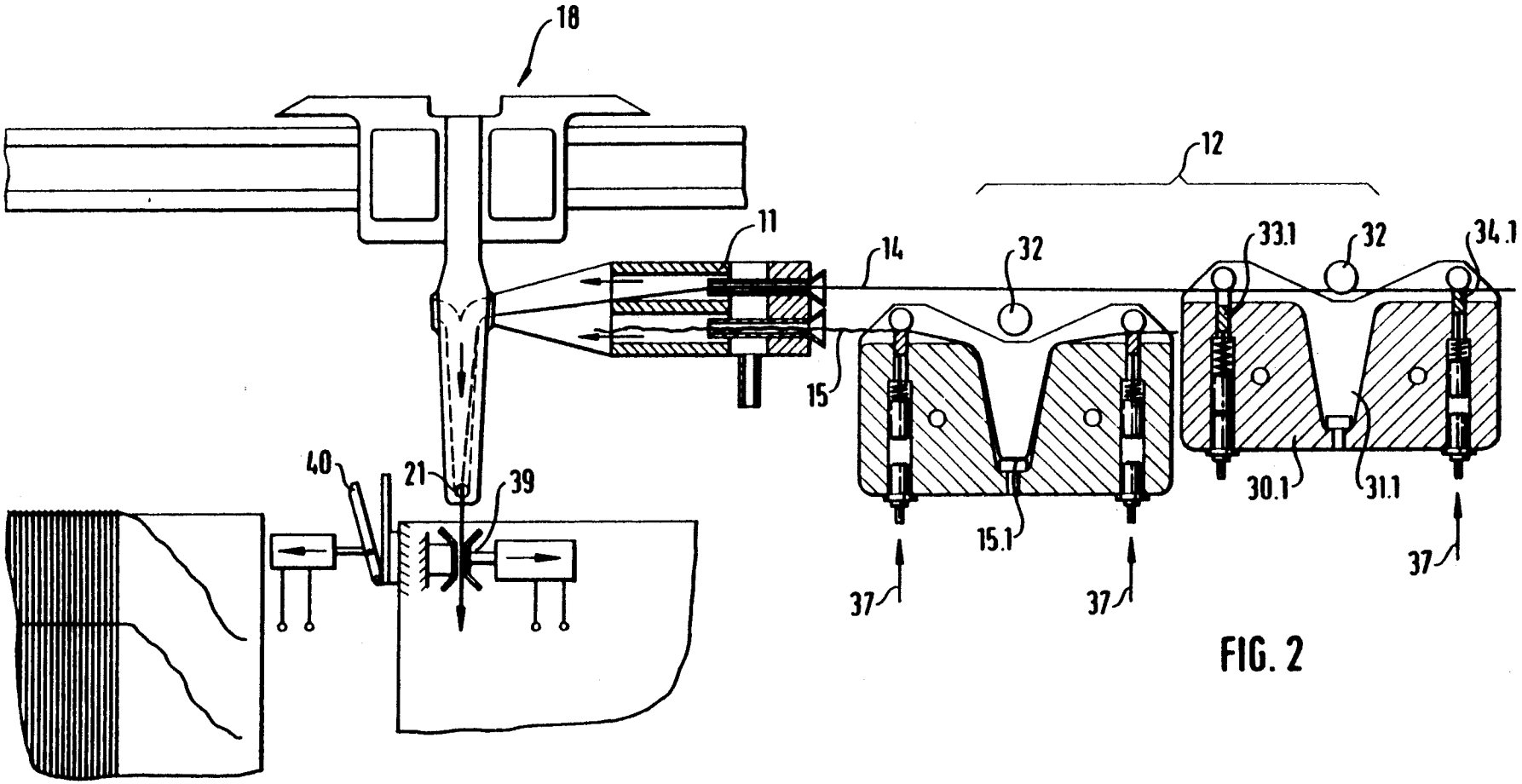
Figure 3:
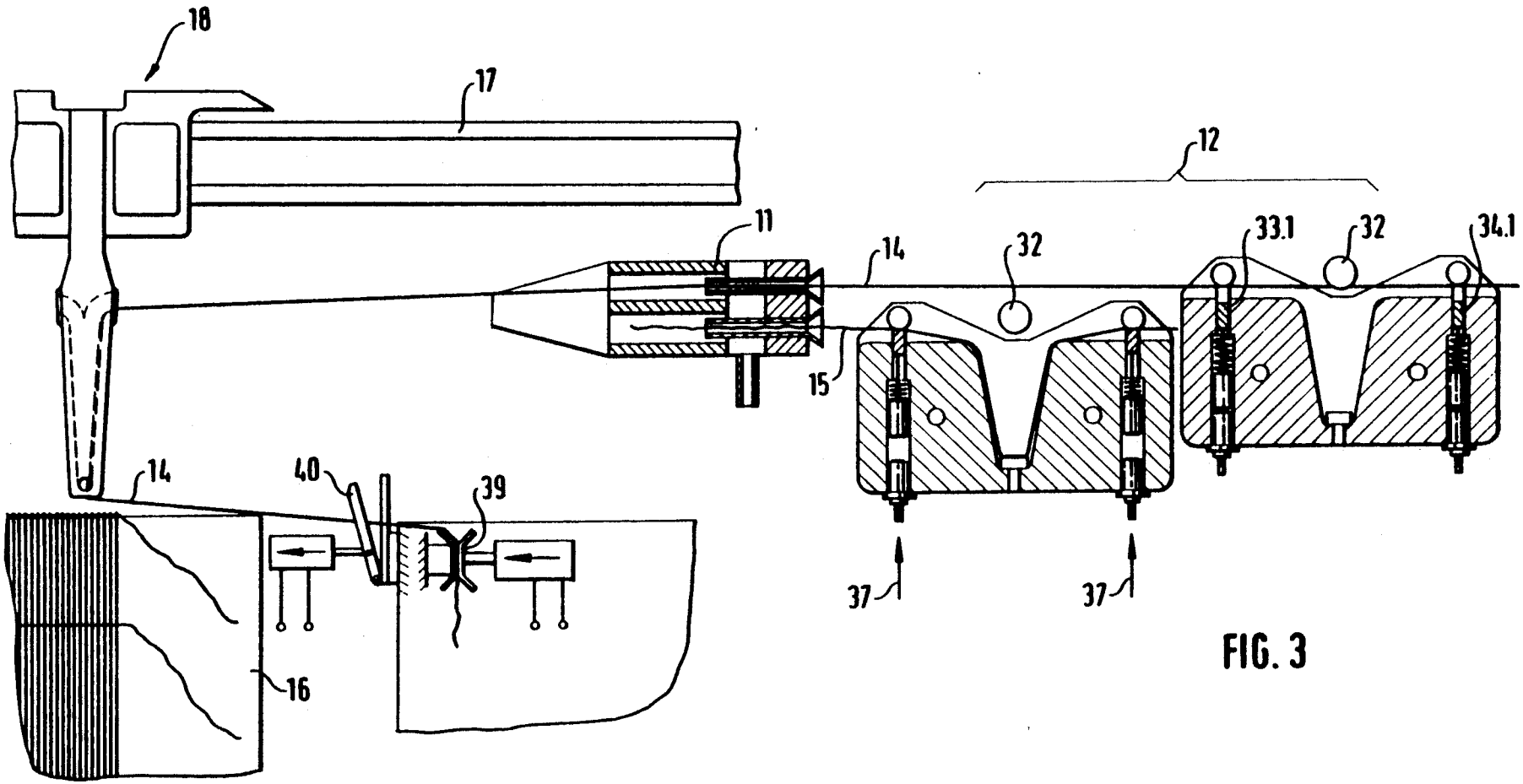
Figure 4:
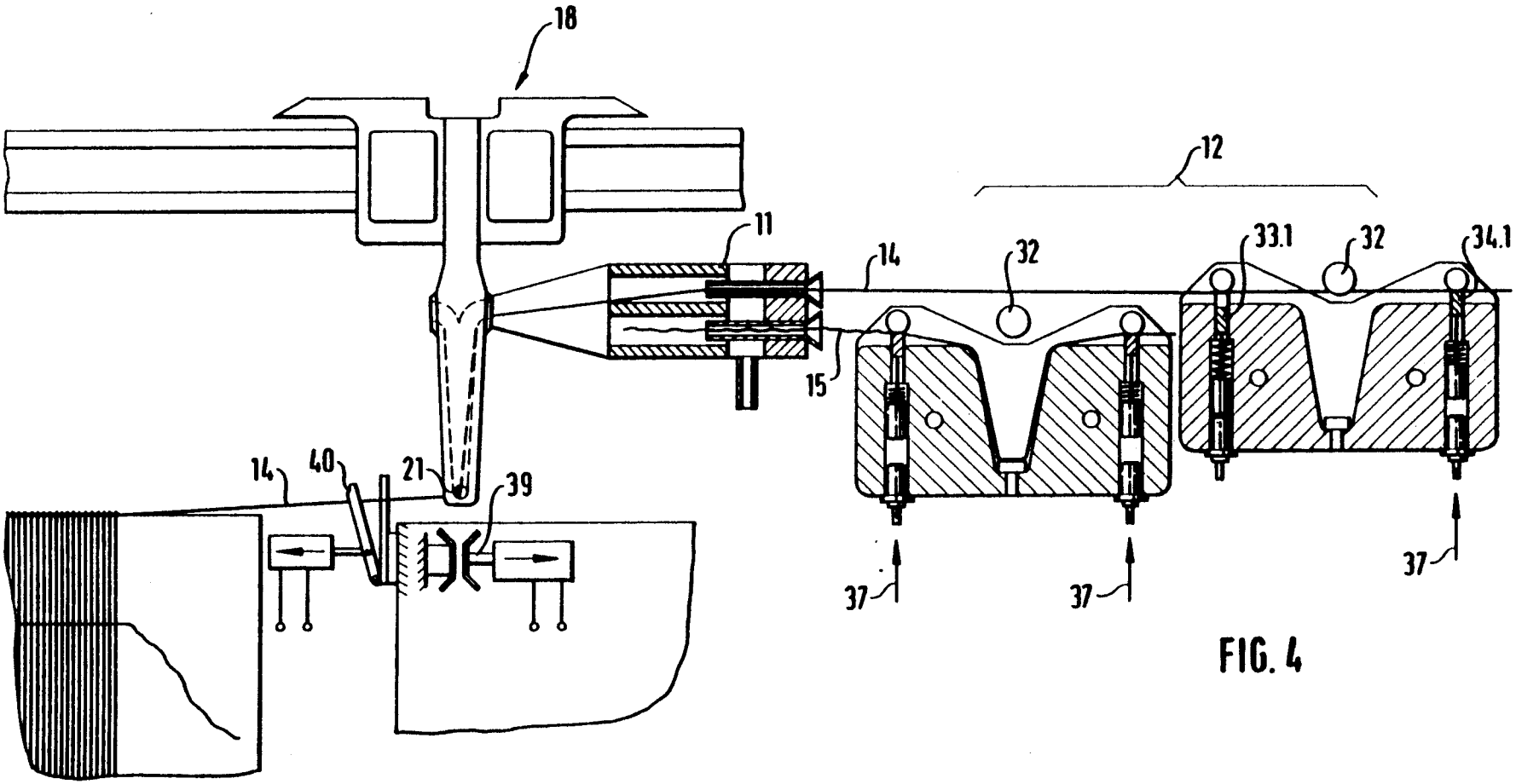

FIG. 1 shows the yarn guide 18 to be equipped with the yarn 14, with the yarn entry orifice 23 of its yarn-guide arm 20 laid against the blowing nozzle 28 of the nozzle head 11. The nozzle head 11 is already subjected to compressed air which flows through the feed line 29 into the blowing space 27, into the blowing nozzle 28 and from there into the yarn-guide channel 24 of the yarn-guide arm 20 and which grasps the end of the yarn 14 located in the nozzle head 11. The front movable clamping jaw 33.1 of the guide body 30.1 of the thread-proportioning part 12 is in the open position, so that the yarn 14 can be driven into the yarn-guide arm 20 by the airstream, with the yarn loop 14.1 thereby being eliminated. The length of the yarn loop 14.1 is calculated so that it is sufficient to bring the start of the yarn 14 through the yarn exit orifice 21 of the yarn guide 18 into the yarn clamp 39, as shown in FIG. 2. After the yarn clamp 39 has closed, in the yarn-proportioning part 12 the rear movable clamping jaw 34.1 of the guide body 30.1 assigned to the yarn 14 is also opened, whereupon, according to FIG. 3, the yarn guide 18 is uncoupled from the nozzle head 11, the yarn 14 thereby being driven and following up, and can be moved on its guide rail 17. As soon as the yarn 14 has been knitted into a few stitches in the needle bed, the additional yarn clamp 39 can be opened, so that the yarn start can fall out of the yarn clamp 39.

Figure 5:
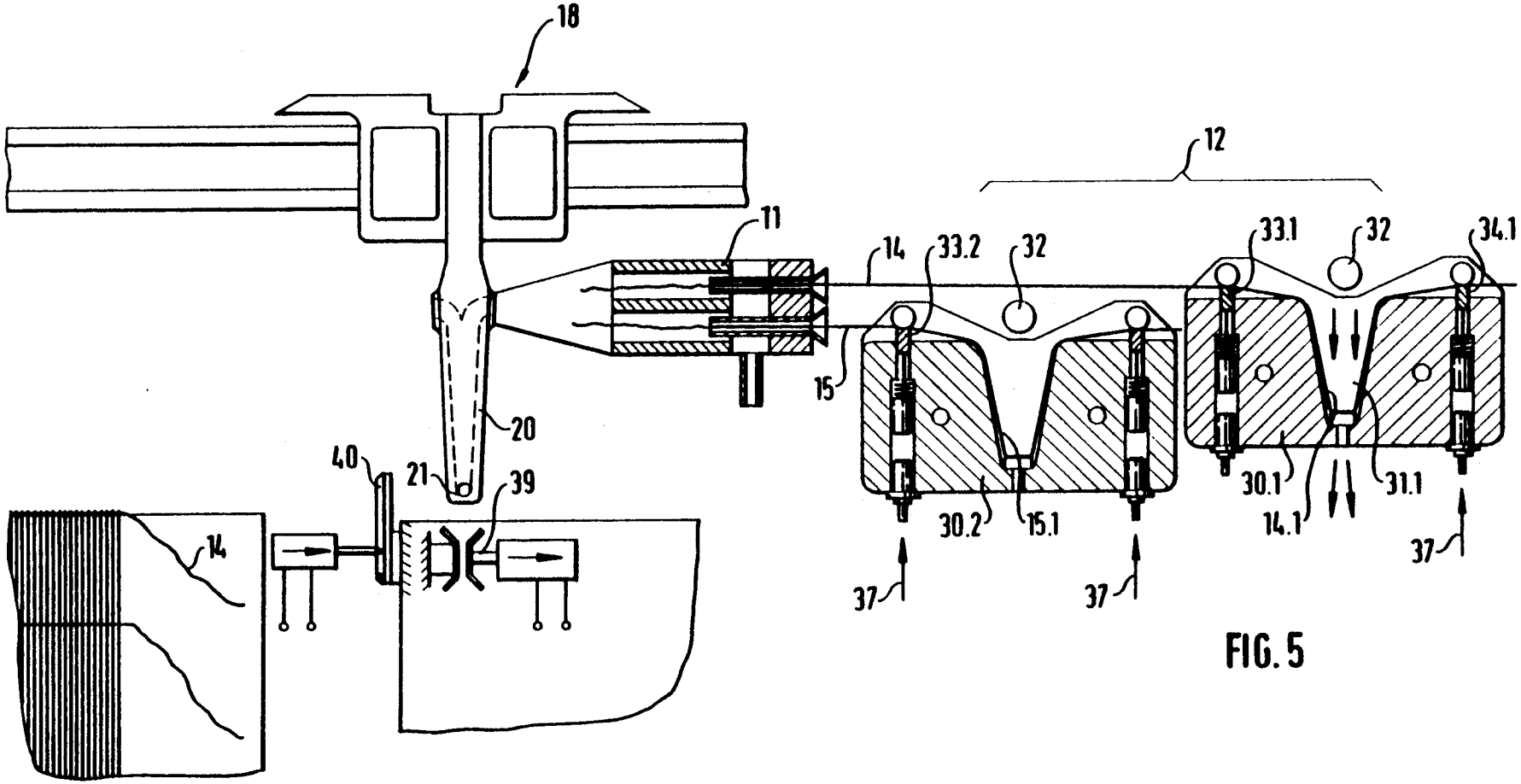

When a yarn change is to take place, the yarn guide 18 is laid once again against the nozzle head 11. At the same time, the yarn 14 guided by the yarn guide 18 is inserted into the yarn shear 40. In the yarn-proportioning part 12, the rear yarn-clamping jaw 34.1 is closed, so that no more yarn 14 can be drawn into the nozzle head 11. Subsequently, the yarn shear 40 is actuated and severs the yarn 14. This state is evident from FIG. 5. After the yarn 14 has been cut off, compressed air is fed to the nozzle bar 32 and the yarn 14 is thereby introduced into the yarn-loop region 31.1 and the guide body 30.1 to form a yarn loop 14.1, and in this respect the yarn loop can be formed simply by drawing the yarn 14 back out of the yarn-guide arm 20 into the nozzle head 11, since only the front clamping jaw 33.1 is opened. Thereafter, the front clamping jaw 33.1 is also closed and the newly formed yarn loop 14.1 is thus protected. For the subsequent insertion of the yarn 15 to the yarn guide 18, the front clamping jaw 33.2 of the guide body 30.2 assigned to the yarn 15 is opened, whereupon the yarn 15 can be blown by means of compressed air out of the blowing nozzle 11, the yarn loop 15.1 thereby being eliminated, into the yarn guide 18 and as far as the region of the yarn clamp 39. The above-described operation is then repeated.

We claim:

1. A threading and yarn-changing device for movable yarn guides of flat knitting machines, comprising:

yarn guides, said yarn guides having at least one yarn guide channel with a yarn entry orifice and a yarn exit orifice; a yarn blowing-nozzle head with a plurality of yarn inlet channels, said nozzle head having a blowing-nozzle upstream of said yarn entry orifice and alignable with said yarn entry orifice of at least one of said yarn guides; a yarn-proportioning part preceding said nozzle head such that yarn is fed from the yarn-proportioning part to the nozzle head, said yarn-proportioning part having a yarn-loop region with a yarn looper, front and rear separately actuable yarn-clamps, the yarn looper being located between said yarn-clamps, and at least one yarn-clamping and cutting-off device for said yarn guides of the flat knitting machine, being positionable downstream from the said yarn exit orifice.

2. A device according to claim 1, wherein the yarn-proportioning pat has a yarn looper common to all of the yarns and comprises a blowing-nozzle bar which is arranged above the plurality of yarn-loop regions.

3. A device according to claim 1, wherein the yarn looper comprises a member extending transversely relative to all of the yarns and lowerable into the plurality of yarn-loop regions arranged next to one another.

4. A device according to claim 1, wherein an assembly including the yarn blowing-in nozzle, the yarn-proportioning part and the yarn-clamping and cutting-off device are arranged on the knitting machine for movement therewith.

5. A device according to claim 1, wherein a yarn clamp of the yarn-clamping and cutting-off device is so arranged that it is located in front of the exit orifice of the yarn guide when the yarn guide lies against the nozzle head.

6. A device according to claim 1, wherein the said yarn-clamps each have a moveable clamping jaw which is coupled to an adjusting member.

* * * * *